US007588271B1

(12) United States Patent
Lawrence

(10) Patent No.: US 7,588,271 B1
(45) Date of Patent: Sep. 15, 2009

(54) WINDOW SECURITY LOCK

(76) Inventor: Barry G. Lawrence, P.O. Box 1109, Thomasville, NC (US) 27360

( * ) Notice: Subject to any disclaimer, the term of this patent is extended or adjusted under 35 U.S.C. 154(b) by 0 days.

(21) Appl. No.: 11/522,165

(22) Filed: Sep. 15, 2006

(51) Int. Cl.
*E05C 17/44* (2006.01)
*E05C 17/54* (2006.01)

(52) U.S. Cl. ..... 292/241; 292/240; 292/338; 292/339; 292/DIG. 20; 292/DIG. 47; 49/449

(58) Field of Classification Search ..... 292/240, 292/241, 338, 339, 63, DIG. 20, DIG. 47; 49/449

See application file for complete search history.

(56) References Cited

U.S. PATENT DOCUMENTS

| | | | | | |
|---|---|---|---|---|---|
| 389,217 | A * | 9/1888 | Glenn | 292/342 |
| 534,185 | A * | 2/1895 | Winchester | 292/63 |
| 804,994 | A * | 11/1905 | Andrews | 292/219 |
| 818,303 | A * | 4/1906 | Seaman | 292/132 |
| 976,777 | A * | 11/1910 | Brown | 292/63 |
| 1,004,262 | A * | 9/1911 | Homan | 292/63 |
| 1,173,129 | A * | 2/1916 | Taliaferro | 292/219 |
| 1,279,353 | A * | 9/1918 | Kelly et al. | 292/219 |
| 1,485,382 | A * | 3/1924 | Foley | 292/219 |
| 1,946,833 | A * | 2/1934 | Brown | 292/228 |
| 2,509,844 | A * | 5/1950 | Saner | 292/63 |
| 2,920,914 | A * | 1/1960 | Jenkins | 292/67 |
| 3,172,168 | A * | 3/1965 | Suska | 49/400 |
| 4,824,154 | A * | 4/1989 | Simpson | 292/338 |
| 4,923,230 | A * | 5/1990 | Simpson | 292/67 |
| 5,139,291 | A | 8/1992 | Schultz | 292/42 |
| 5,219,195 | A | 6/1993 | Lawrence | 292/336.3 |
| 5,248,174 | A | 9/1993 | Matz et al. | 292/338 |
| 5,536,052 | A | 7/1996 | Maier | 292/63 |
| 5,575,116 | A * | 11/1996 | Carlson et al. | 49/449 |
| 5,669,180 | A | 9/1997 | Maier | 49/181 |
| 5,669,639 | A | 9/1997 | Lawrence | 292/175 |
| 5,970,656 | A | 10/1999 | Maier | 49/181 |
| 5,996,283 | A | 12/1999 | Maier | 19/181 |
| 6,068,306 | A | 5/2000 | Brautigam | 292/242 |
| 6,142,541 | A | 11/2000 | Rotondi | 292/241 |
| 6,364,375 | B1 | 4/2002 | Szapucki et al. | 292/63 |
| 6,450,554 | B1 | 9/2002 | Rotondi et al. | 292/158 |
| 6,484,444 | B1 | 11/2002 | Polowinczak | 49/449 |
| 6,568,723 | B2 | 5/2003 | Murphy et al. | 292/241 |
| 6,572,158 | B2 * | 6/2003 | Szapucki et al. | 292/221 |
| 6,767,038 | B1 | 7/2004 | Huml | 292/158 |
| 6,854,214 | B2 | 2/2005 | Polowinczak | 49/449 |
| 6,871,886 | B2 | 3/2005 | Coleman et al. | 292/241 |
| 7,000,957 | B2 | 2/2006 | Lawrence | 292/241 |
| 2005/0011131 | A1 * | 1/2005 | Liang et al. | 49/449 |

OTHER PUBLICATIONS

U.S. Appl. No. 11/110,172, filed Apr. 20, 2005, Barry G. Lawrence.
U.S. Appl. No. 11/136,066, filed May 24, 2005, Barry G. Lawrence.
U.S. Appl. No. 11/274,540, filed Nov. 15, 2005, Barry G. Lawrence.
U.S. Appl. No. 10/867,370, filed Jun. 14, 2004, Lyn O. Trickel.

* cited by examiner

*Primary Examiner*—Carlos Lugo

(57) ABSTRACT

A security lock for a window jamb includes a pivotable stop for use on single hung, double hung and other type windows. The stop is manually operated to limit the window opening to about four inches to prevent unauthorized entry. The stop incorporates a lip which closes the stop opening to thereby prevent dust, debris and insect infiltration.

11 Claims, 5 Drawing Sheets

WINDOW SECURITY LOCK

FIELD OF THE INVENTION

The invention herein pertains to security locks and particularly pertains to window security locks which utilize a pivotal stop.

DESCRIPTION OF THE PRIOR ART AND OBJECTIVES OF THE INVENTION

In recent years with the increase in security awareness window security locks have become a more important feature of single hung, double hung and other type windows. Such locks are used to limit the window opening to prevent unauthorized persons from entering while simultaneously allowing sufficient ventilation. Such locks are generally mounted on the inside window jambs for manual operation as needed. Problems have arisen with prior window security locks in that the weather stripping seals placed for example on the lower window sash headers have inadvertently triggered the security locks, causing lock jams and breakage. Some conventional security locks have been broken due to high impact with the sash header, as when an excessive force is applied to open the sash. Other prior window security locks have failed due to insect, dust and debris infiltration.

Thus based on the disadvantages and problems associated with prior window security locks, the present invention was conceived and one of its objectives is to provide a window security lock which can be manufactured and installed in conventional single hung, double hung or other type window jambs at a reasonable price.

It is yet another objective of the present invention to provide a window security lock which will not inadvertently open during normal window sash movement.

It is still another objective of the present invention to provide a window security lock which has relatively few parts, with the main parts molded from a standard, durable polymeric material such as nylon.

It is also an objective of the present invention to provide a window security lock having a pivotable stop which is manually operated.

It is yet a further objective of the present invention to provide a window security lock with a stop having chamfered surfaces to provide for additional structural integrity and security.

Various other objectives and advantages of the present invention will become apparent to those skilled in the art as a more detailed description is set forth below.

SUMMARY OF THE INVENTION

The aforesaid and other objectives are realized by providing a window security lock having a pivotable stop contained within a rectangularly shaped housing. A resilient member in the form of a coil spring drives the stop outwardly from the housing through an opening located on the housing face. The face opening length is in excess of the exposed stop and a lip located on the stop inside the housing closes the opening and prevents infiltration of dirt, insects and debris during use. The stop defines a triangularly shaped slot for maintaining the spring and allowing spring rotation thereof as the stop moves from an extended to a retracted position within the housing. A pair of posts mounted on the inside of the housing anchors the lower end of the spring during operation of the stop. A pair of pivot pins located on the stop engage slots within each side of the housing to allow rotation of the stop. A cover positioned on one side of the housing permits assembly and disassembly of the housing by the use of small pegs on the housing cover which engage sockets in the housing. Chamfered surfaces on the stop provide structural integrity to the lock as the chamfered surfaces engage the inner housing walls when the stop is extended in the security mode. To extend the stop for security purposes finger pressure is applied to the front, exposed ridges of the stop, the stop is forced inwardly, compressing the resilient member. By then urging the stop upwardly while under pressure, the pivot pins bypass indents in the housing slots and allow upward vertical movement of the stop. Upon release, the stop pivots by resilient action of the spring and extends from the housing through the front opening. With the security lock mounted in the upper sash jamb, by raising the lower sash only a limited distance the stop is struck by the sash header and upward movement of the sash is terminated. The user thereby benefits by having a few inches of open window space while at the same time preventing unauthorized entry such as by a burglar through a greater window opening.

DETAILED DESCRIPTION OF THE PREFERRED EMBODIMENT AND OPERATION OF THE INVENTION

Figure 1:
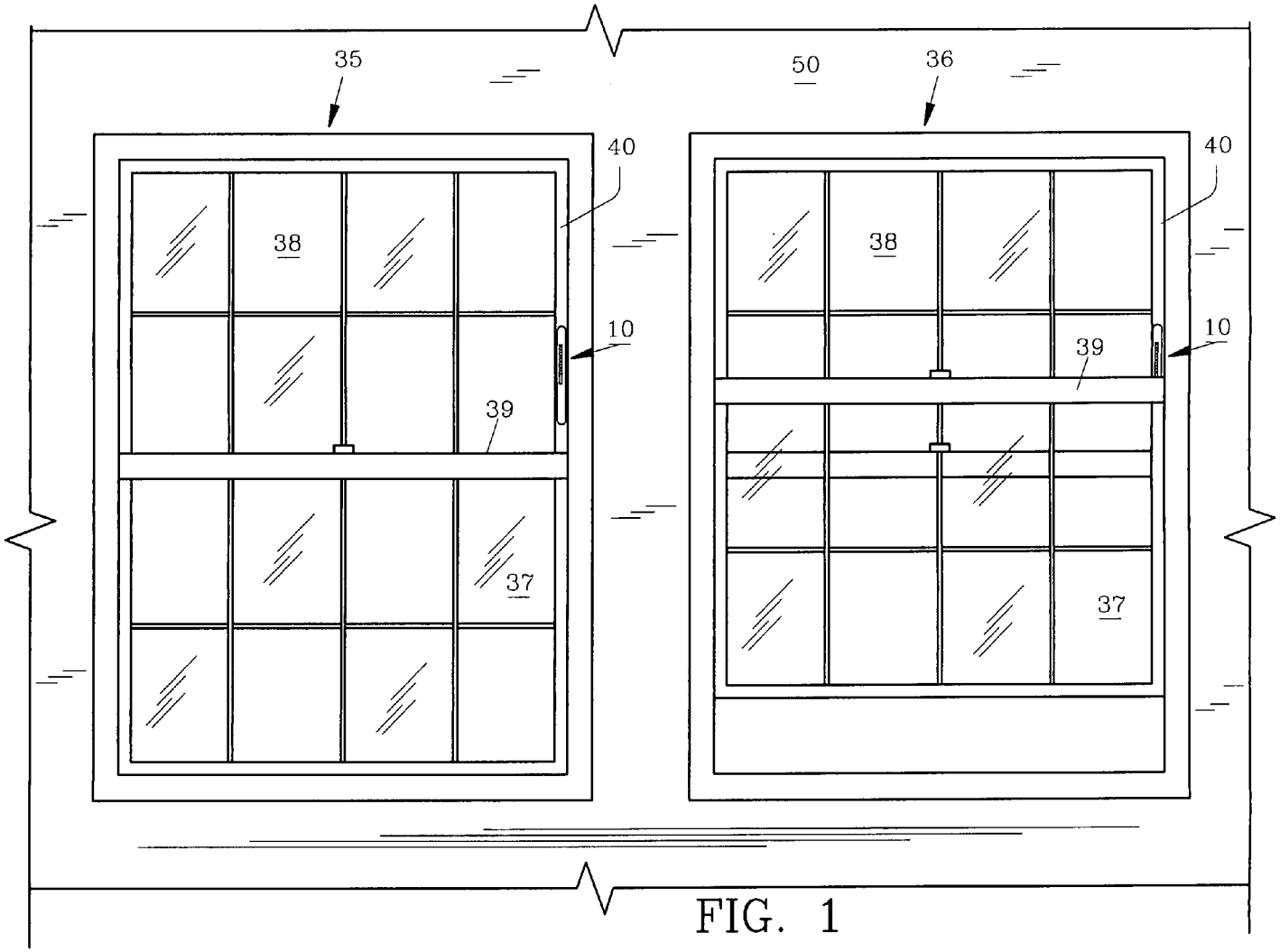
FIG. 1 shows a typical inside building wall with a pair of double hung windows therein with a window security lock mounted on each window.

For a better understanding of the invention and its operation, turning now to the drawings, FIG. 1 illustrates preferred security window locks 10 as installed for closed double hung window 35 and partially opened double hung window 36 both mounted in wall 50 of a typical house or other building. Security lock 10 is preferably formed from conventional nylon. Glass reinforced nylon can be used for greater strength but is not preferred. As shown for window 36, security window lock 10 is opened or extended to prevent full ascension of lower sash 37. As featured, upper sash 38 may be rendered fixed such as by nails, screws or other hardware (not shown). Bottom sash 37 of window 36 shown in FIG. 1 is raised approximately four inches and therefore security is provided by limiting the window opening thereby preventing burglars or other unauthorized persons from entering the building through window 36, while at the same time allowing abundant fresh air to enter.

Figure 2:
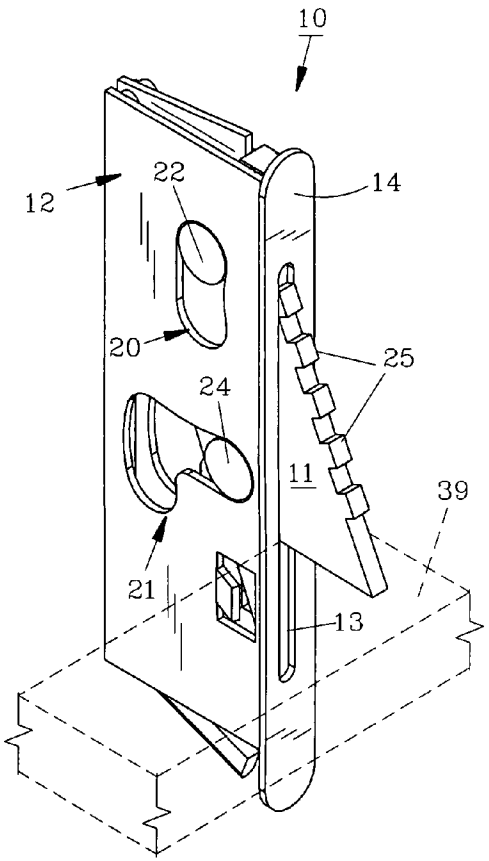
FIG. 2 illustrates the preferred form of the window security lock in a front left side perspective view as removed from the window and with a partial window sash header shown in ghost fashion.
Figure 4:
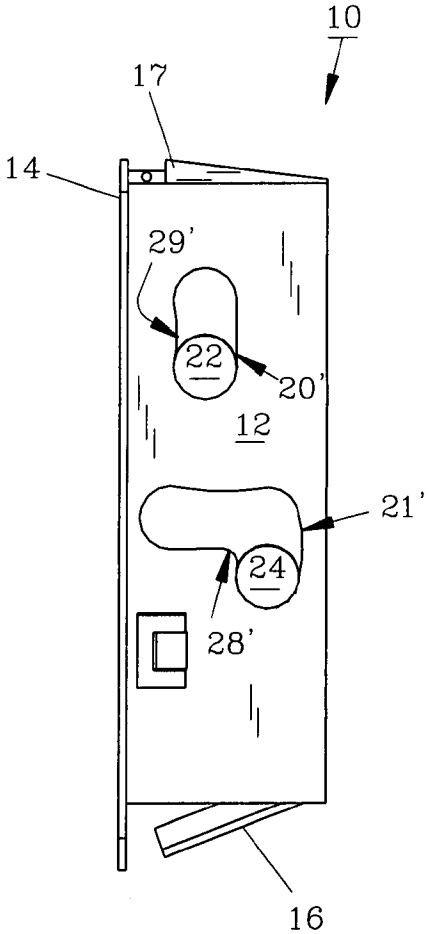
FIG. 4 pictures the window security lock as in FIG. 3 but with the stop retracted.
Figure 3:
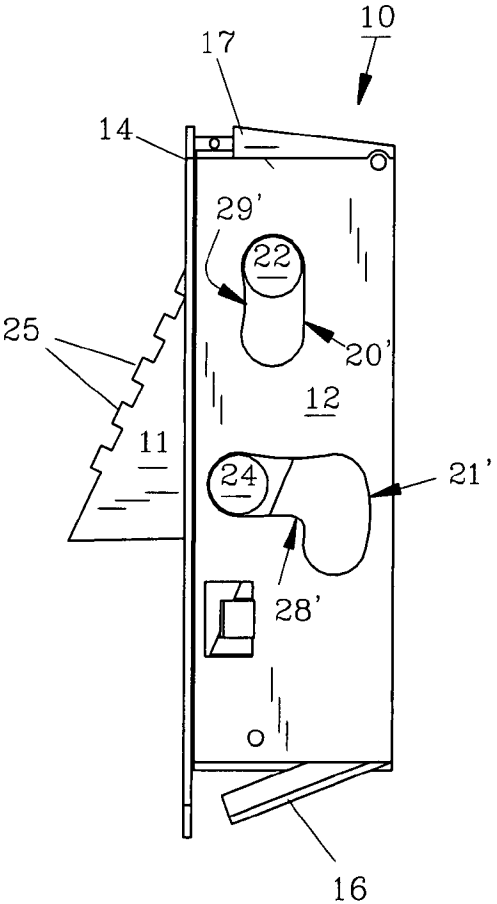
FIG. 3 demonstrates a right side elevational view of the window security lock with the stop in an extended posture.
Figure 6:
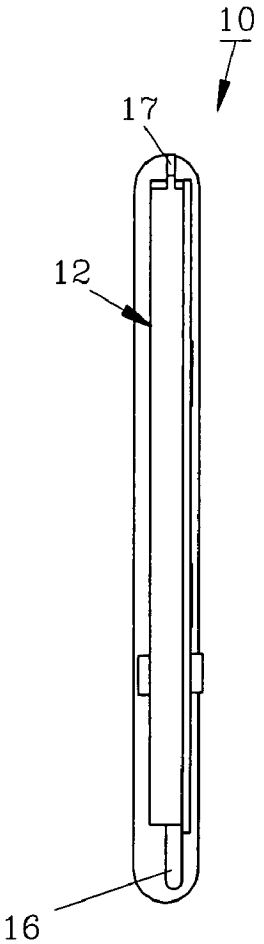
FIG. 6 shows a rear elevational view of the window security lock.

In FIG. 2 a perspective view of preferred security window lock 10 is seen with stop 11 extended outwardly from face 14 of housing 12 to terminate upward motion of sash 37 by engaging window sash header 39 shown in dotted lines. As seen in FIGS. 3, 4 and 6 housing 12 includes top fixed finger 17 and bottom flexible finger 16 which engage window jamb 40 during mounting of security lock 10. Partial window jamb 40 as shown in dotted lines in FIG. 8 is conventionally formed from vinyl or aluminum.

Figure 5:
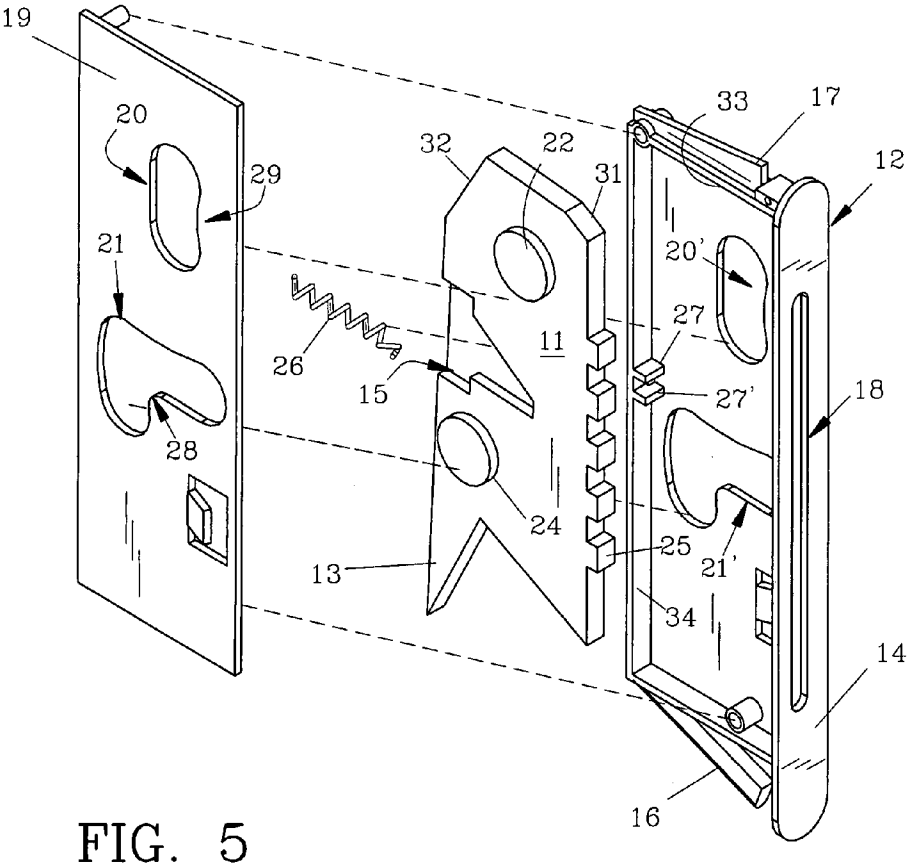
FIG. 5 depicts the window security lock in a front, left side, perspective, exploded view.

As further seen in FIGS. 2, 3, 4 and 5, housing 12 includes elongated slots 20, 20' and L-shaped slots 21, 21'. Elongated slots 20, 20' contain pivot pin 22 which is affixed to stop 11 whereas L-shaped slots 21, 21' contain pivot pin 24 also affixed to stop 11 as shown in FIG. 5. Slots 20, 20' include respectively indents 29, 29' and L-shaped slots 21, 21' respectively include indents 28, 28' formed therein to assist in maintaining and controlling the movement of stop 11 within housing 12 during operation.

Figure 9:
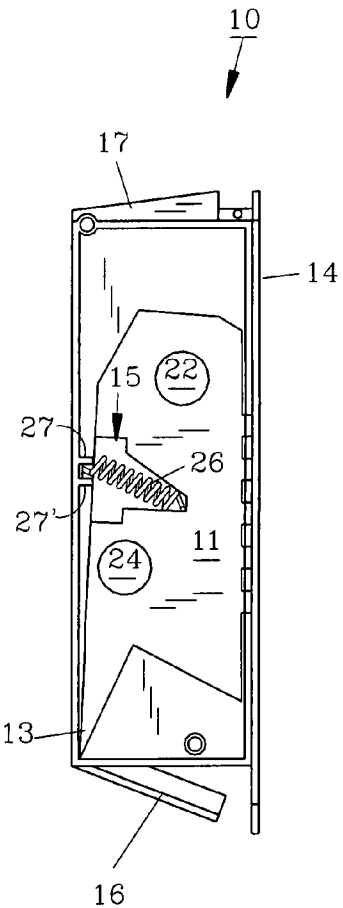
FIG. 9 illustrates the window security lock as in FIG. 8 but without the window jamb and with the stop retracted.
Figure 8:
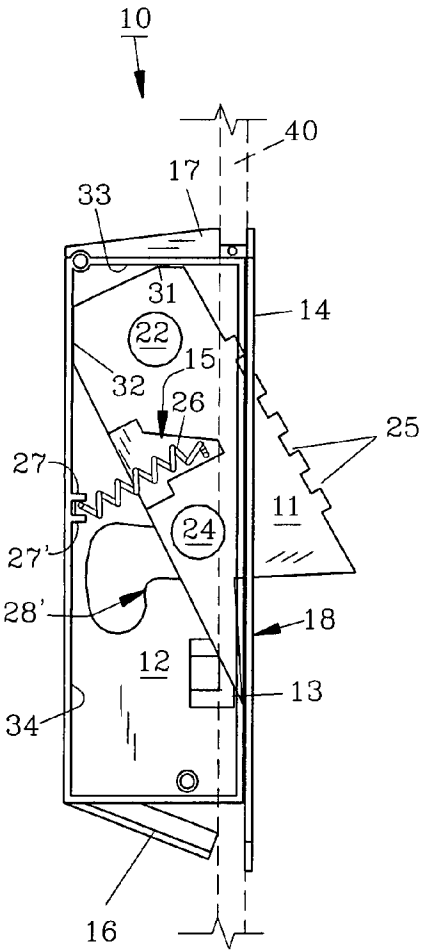
FIG. 8 features a left side elevational view of the window security lock with the cover removed, with the stop extended as mounted in a window jamb which is shown in ghost fashion.

Stop 11 seen in FIG. 5 includes wedge shaped lip 13 which engages the lower inner surfaces at opening 18 in housing face 14 when stop 11 is extended from housing 12, shown for example in FIGS. 2 and 8. Lip 13 as illustrated prevents debris and insect entry into housing 12 through stop opening 18 as it closes opening 18 below extended stop 11 as seen in FIG. 2. Stop 11 further includes slot 15 for containing a resilient member such as coil spring 26 shown in FIGS. 8 and 9. Slot 15 is somewhat triangularly shaped to permit movement of coil spring 26 positioned therein. As shown in FIGS. 5, 8 and 9 housing 12 includes posts 27, 27' to assist in maintaining the lower end of spring 26 which rotates in slot 15 as stop 11 pivots from an open position (FIG. 8) to a closed position (FIG. 9). Triangularly shaped slot 15 thus allows space for coil spring 26 to rotate and prevents binding of coil spring 26 during operation of stop 11.

As seen in FIG. 5 stop 11 includes chamfered surfaces 31 and 32 which engage respectively, inner housing surfaces 33 and 34 when stop 11 is extended as seen in FIG. 8. This engagement with housing 12 provides strength and integrity to window security lock 10. Should lower sash 37 be forcibly opened impacting stop 11, chamfered surfaces 31 and 32 braced against respectively inner housing surfaces 33, 34 provide a solid support to prevent breakage of window lock 10.

Figure 7:
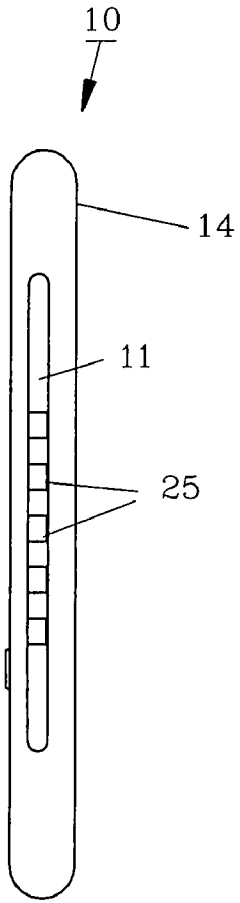
FIG. 7 demonstrates a front elevational view of the window security lock with the stop retracted.

Many standard single and double hung windows include a resilient seal (not seen) on the top inside of lower sash header such as lower sash header 39 shown in FIG. 1. This seal is provided to prevent outside air infiltration and consequently may contact face 14 (FIG. 7) of window security lock 10 when lower sash 37 is raised. Thus to prevent interference with security lock 10 by such seals, stop 11 is mounted within housing 12 to be slightly depressed as seen in FIGS. 4 and 9. To utilize window lock 10 the user applies finger pressure to ridges 25 of retracted stop 11 as seen in FIG. 4 when window lock 10 is closed to drive stop 11 slightly inwardly and by pushing stop 11 upwardly (towards fixed finger 17), pivot pin 24 bypasses indent 28' of slot 21' and pivot pin 22 bypasses indent 29' of slot 20'. Stop 11 thus moves upwardly and spring 26 can then expand and force stop 11 through opening 18 as shown in FIGS. 2 and 3. Pivot pin 24 is now at the upper ends of L-shaped slots 21, 21' as shown in FIGS. 2 and 3. When so opened stop 11 will be available to engage window sash header 39 as seen on window 36 in FIG. 1 to limit the window opening. Indents 28, 28', 29 and 29' prevent inadvertent operation of security lock 10 by contact with a sash header seal during normal opening of the window sash.

The illustrations and examples provided herein are for explanatory purposes only and are not intended to limit the scope of the appended claims. As an example of an obvious modification as may be made by a skilled artisan, pivot pins 22, and slots 20, 20', 21, 21' could be reversed, i.e. pivot pins 22, 24 could be located on housing 12 and cover 19 and slots 20 21' could be positioned in stop 11 without changing the function or advantages of window security lock 10. Various other changes could also be made.

I claim:

1. A window security lock comprising:

a housing, said housing defining an elongated slot and an L-shaped slot, a pair of posts, said posts mounted on said housing, a stop, said stop slidably mounted within said housing, said housing defining a first indent, a second indent, said housing first indent extending into said housing elongated slot, said housing second indent extending into said housing L-shaped slot, a cover, said cover defining an elongated slot and an L-shaped slot, said cover defining a first indent, a second indent, said cover first indent extending into said cover elongated slot, said cover second indent extending into said cover L-shaped slot, said cover contiguous said housing for maintaining said stop therebetween, said stop comprising a body, said body defining a pair of chamfered surfaces, a first pin, said first pin attached to said stop and positioned in said housing elongated slot and in said cover elongated slot, a second pin, said second pin attached to said stop and positioned in said housing L-shaped slot and in said cover L-shaped slot, a lip, said lip attached to said body, a resilient member, said resilient member contiguous said stop, said lip for engaging said housing when said stop is pivoted outwardly therefrom while said chamfered surfaces engage said housing, said resilient member angularly contained between said posts whereby said resilient member is freely rotatable from one angular position toward an opposed annular position as said stop pivots, said resilient member comprising a coil spring.

2. The window security lock of claim 1 further comprising a rigid fixed finger, said fixed finger attached to said housing for engaging a window frame.

3. The window security lock of claim 2 further comprising a flexible finger, said flexible finger attached to said housing in opposing relation to said fixed finger for engaging a window frame.

4. The window security lock of claim 1 wherein said stop defines a spring slot, said resilient member residing within said spring slot.

5. The window security lock of claim 4 wherein said spring slot is triangularly shaped.

6. The window security lock of claim 1 wherein said housing defines a stop opening, said stop opening to allow said stop to pivot from said housing.

7. The window security lock of claim 6 wherein said lip will obstruct said stop opening when said stop extends from said housing.

8. A security lock mountable in the upper sash jamb of a double hung window, the lock openable to prevent ascension of the lower sash by engagement with the header of the lower sash and closable to permit ascension of the lower sash, the lock comprising:

a housing, said housing defining an elongated slot and an L-shaped slot, said housing elongated slot and said housing L-shaped slot each defining an indent, a cover, said cover attached to said housing, said cover defining an elongated slot and an L-shaped slot, said cover elongated slot and said cover L-shaped slot each defining an indent, said housing elongated slot coincidental with said cover elongated slot, said housing L-shaped slot coincidental with said cover L-shaped slot; and a pivotable stop, a pair of pivot pins, said stop fixed to said pivot pins, said pivot pins positioned to slide within said elongated slots and said L-shaped slots of both said cover and said housing simultaneously and all of said indents for preventing inadvertent operation of said stop, said stop defining a pair of chamfered surfaces engaging interior surfaces of said housing, a lip, said lip for reducing debris and insect entry when the lock is open, a coil spring, said stop defining a spring slot, a pair of posts, said pair of posts attached to said housing, said coil spring having one end contained in said spring slot and the opposite end maintained by said pair of posts, positioning the coil spring at an angle, whereby said coil spring is rotatable from one angular position toward an opposed angular position as said stop pivots.

9. The security lock of claim 8 wherein said stop further comprises ridges, said housing comprising a face, said ridges recessed behind said housing face when the lock is closed for avoiding a sash header seal on the lower sash.

10. The security lock of claim 8 wherein said L-shaped slots are below said elongated slots and the bottom of said stop slides outwardly to prevent ascension of the lower sash.

11. The security lock of claim 8 wherein said spring slot is triangularly shaped.

* * * * *